US008281776B2

(12) United States Patent
Körver et al.

(10) Patent No.: US 8,281,776 B2
(45) Date of Patent: Oct. 9, 2012

(54) WEAPON, IN PARTICULAR RANGE-CONTROLLED COMPRESSED AIR WEAPON

(75) Inventors: Rolf Körver, St. Georgen (DE); Sven Guth, Müllheim (DE); Michael Niemann, Müllheim (DE); Michael Köpf, Müllheim (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 0 days.

(21) Appl. No.: 12/844,655

(22) Filed: Jul. 27, 2010

(65) Prior Publication Data

US 2011/0073093 A1 Mar. 31, 2011

Related U.S. Application Data

(60) Provisional application No. 61/253,686, filed on Oct. 21, 2009.

(30) Foreign Application Priority Data

Jul. 27, 2009 (DE) ..... 10 2009 034 888
Sep. 14, 2009 (DE) ..... 10 2009 041 094

(51) Int. Cl.
*F41B 11/06* (2006.01)

(52) U.S. Cl. ..... 124/73

(58) Field of Classification Search ..... 124/73
See application file for complete search history.

(56) References Cited

U.S. PATENT DOCUMENTS 556,058 A 3/1896 Huey
1,709,496 A 4/1929 Smyth
1,743,576 A * 1/1930 Smith ..... 124/72
2,791,944 A * 5/1957 Harvey ..... 89/193
3,536,054 A 10/1970 Stephens
4,137,893 A * 2/1979 Beauchamp ..... 124/72
4,833,961 A 5/1989 Adini
5,415,152 A 5/1995 Adamson et al.
7,806,113 B2 * 10/2010 Skilling ..... 124/73
2002/0170551 A1 * 11/2002 Kotsiopoulos et al. ..... 124/54
2003/0106545 A1 * 6/2003 Verini ..... 124/74
2003/0168052 A1 * 9/2003 Masse ..... 124/73
2005/0188976 A1 9/2005 Warnock
2006/0027224 A1 * 2/2006 Lin ..... 124/70

(Continued)

FOREIGN PATENT DOCUMENTS

CH 624 480 A5 7/1981

(Continued)

OTHER PUBLICATIONS

L-Tan Air Cannons Engineering Ltd., downloaded on webpage of l-TAN, www.l-tan.com/cannon4.asp., dated Oct. 14, 2010, pp. 1-2.

(Continued)

*Primary Examiner* — Michael David

(74) *Attorney, Agent, or Firm* — Griffin & Szipl, P.C.

(57) ABSTRACT

The invention pertains to a weapon that provides a range control (2), by means of which it is possible to set firing velocity, and thus impact velocity, of the ammunition or active bodies (10) to a distance to be discharged in such a way that, in particular, the non-lethal ammunition (10) continues to have a non-lethal effect. To this end, a type of pneumatic weapon (1) is described that, with the use of a shot pressure control, e.g. by means of a proportional pressure regulator (3), and/or additionally in combination with breech technology and valve technology, has a continuously variable range control.

16 Claims, 5 Drawing Sheets

U.S. PATENT DOCUMENTS

| | | | | |
|---|---|---|---|---|
| 2007/0017496 | A1 * | 1/2007 | Hill | 124/73 |
| 2009/0007765 | A1 | 1/2009 | Hunn et al. | |
| 2009/0145414 | A1 | 6/2009 | Russell et al. | |

FOREIGN PATENT DOCUMENTS

| | | | |
|---|---|---|---|
| DE | 49631 | | 11/1889 |
| DE | 3731044 | A1 * | 3/1989 |
| DE | 10 2005 040 406 | A1 | 3/2007 |
| DE | 10 2005 040 407 | A1 | 3/2007 |
| DE | 10 2007 029 623 | A1 | 2/2009 |
| DE | 10 2008 058 776 | A1 | 5/2010 |
| EP | 0 037 870 | A1 | 10/1981 |
| EP | 1 793 166 | A1 | 6/2007 |
| WO | 93/25861 | A1 | 12/1993 |

OTHER PUBLICATIONS

Austro-Hungarian Mortars During WWI, downloaded on webpage of www.landships.freeservers.com/ah_ww1mortars.htm, dated Sep. 27, 2010, pp. 1-4.

WWII Artillery Notes—Ballistics, at http://www.poeland.com/tanks/artillery/ballistics.html (downloaded Jan. 9, 2011), one page.

How to Build the Ultimate Tippmann Sniper Paintball Gun: 12 Steps, at http://wikihow.com/Build-the-Ultimate-Tippman-Sniper-Paintball-Gun (downloaded Jan. 10, 2011), three pages.

How Paintball Works, at http://entertainment.howstuffworks.com/paintball1.htm (downloaded Jan. 10, 2011), two pages.

* cited by examiner

WEAPON, IN PARTICULAR RANGE-CONTROLLED COMPRESSED AIR WEAPON

This application claims priority from U.S. Provisional Patent Application No. 61/253,686, filed Oct. 21, 2009. This application also claims priority on German Patent Application No. 10 2009 034 888.3, filed Jul. 27, 2009, and this application also claims priority on German Patent Application No. 10 2009 041 094.5, filed Sep. 14, 2009. The entire disclosures of the above three patent applications are incorporated herein by reference.

FIELD OF THE INVENTION

The invention relates to a threat-aimed range-controlled compressed air weapon for discharging a need-orientated active composition of lethal, as well as non-lethal, active agents.

BACKGROUND OF THE INVENTION

From DE 10 2007 029 623 A1 a throwing apparatus with magazine is known that has several firing cups and throwing bodies situated therein. The firing cups are mounted in a drum around a drum rotation axis with various elevation angles. By these means, several firing cups form an aiming range of the thrower of 360° all around. The entire thrower can be azimuth aligned. The electrical ignition voltage is conducted to the throwing cups via a slip-ring transformer.

In case of a threat, throwing apparatuses of this type discharge appropriate throwing bodies. The active bodies are thereby ejected from the firing cups at a constant speed defined by the propellant and subsequently develop their active agents.

The not previously published DE 10 2008 058 776.1, for example, relates to the firing of non-lethal ammunition by means of a weapons system. It is provided here that so-called "boom-boom" projectiles are fired by small arms. In addition, the firing of non-lethal ammunition in the medium-caliber range is mentioned in DE 10 2005 040 407 A1, as well as in DE 10 2005 040 406 A1.

In principle, non-lethal ammunition is used wherever unrest, or the like, or police operations take place. In particular, firing from larger weapons (for example 40 mm) can lead to collateral damage, which according to the principle of proportionality can frequently not be tolerated. Known non-lethal ammunition that can be fired is, for example, the irritant round or the impulse round.

Mortars based on compressed air have already been known for a 100 years (http://www.landships.freeservers.com/ahww1mortars.htm). DE 49631 and U.S. Pat. No. 1,709,496 and U.S. Pat. No. 556,058 are also concerned with old compressed air weapons of this type.

Various other pneumatic weapons, or throwers driven by compressed air, etc., are described in US 20090145414 A1, US 20090007765 A1, US 20050188976 A1, or U.S. Pat. No. 3,536,054 A, as well as U.S. Pat. No. 4,833,961 A.

A new type of air cannon is also disclosed on the internet pages http://www.I-tan.com/ and http://www.I-tan.com/cannon4.asp. In EP 1 793 166 B1, a similar industrial cannon is used for the internal cleaning of industrial furnaces, bunkers, and the like, as well as for the shattering of material aggregations by bombarding them with it. The method excels in that the bombardment takes place by means of a projectile with a percussion fuse and a charge of explosive, or pyrotechnical material, from an industrial cannon driven by compressed air.

CH 624 480 A5 proposes that, for unloading a muzzle-loader, a source of compressed air be assigned to the weapon that introduces dosed amounts of compressed air into the inner barrel end in order to eject a loaded bullet from the barrel, but just far enough that it can be grasped securely.

The ballistic device disclosed by EP 0 037 870 B1 has a drive barrel provided with a vessel containing compressed air ahead of it. The latter is connected to the drive barrel by means of a lateral opening. The opening itself is sealed tightly by means of the projectile when the projectile is situated in the firing position. In addition, the device has a trigger mechanism that enables the projectile to be pushed in the barrel for a distance that suffices to cover the opening.

A firing device, embodied as a muzzle-loader, is also known from U.S. Pat. No. 5,415,152 A. In this known firing device, the shot is fired in that a closing valve situated between a launching tube and a pressure vessel is opened only during a precisely specified period of time so that a predetermined amount of compressed gas strikes the rear zone of the projectile body, and ejects it from the launching tube. The fixing device, provided in this firing device for fixing the position of the projectile body in the launching tube, is essentially composed of a steel spring, which is selected such that it positions the projectile body in the correct position before firing, but when the projectile body is impacted by pressure, it is not hindered while being pushed out of the weapon barrel.

Known weapons for firing, in particular, larger caliber ammunition, have the disadvantage that at close range of, for example 20-100 m, effects cannot be adequately controlled.

A pneumatic thrower for firework projectiles is described in WO 93/25861 A1, and has a drum, wherein the respective drum tube is rotated over the pressure vessel so that the projectile situated in this barrel can be ejected.

In the present case, the object of the invention is to provide a weapon for firing lethal ammunition, and also non-lethal ammunition, wherein the weapon is also suitable for use at close range.

SUMMARY OF THE INVENTION

The object of the present invention is achieved by the features of a first embodiment, which pertains to a weapon (1) having at least one weapon barrel (6, 7) and a range control (2) that comprises a compressed air vessel (3) and a valve (4) on each breech (5, 9) of the weapon barrel (6, 7), as well as an incorporated accommodation for the ammunition (10), preferably above the weapon barrels (6, 7), characterized in that the range control (2) is realized by regulating the shot pressure, wherein this takes place, on the one hand, by regulating the operating gas pressure and/or, on the other hand, by influencing the valve characteristics (valve opening time). Advantageous additional embodiments are summarized below as follows.

In accordance with a second embodiment of the present invention, the first embodiment is modified so that the desired range is transmitted to the compressed air vessel or the valve (3) as a signal value via a control. In accordance with a third embodiment of the present invention, the first embodiment or the second embodiment is further modified so that a maximum gas pressure is set in the compressed air vessel (3) and the valve (4) is opened for each operating pressure or shot pressure within an optimum opening time. In accordance with a fourth embodiment of the present invention, the first embodiment, the second embodiment, and the third embodiment are further modified so that the accommodation of the ammunition (10) is, for example, a rotating drum magazine (8), a bar magazine (18) or a chain magazine (28).

In accordance with a fifth embodiment of the present invention, the first embodiment, the second embodiment, the third embodiment, and the fourth embodiment are further modified so that to aim the weapon (1), a control (11) for the vertical positioning of the weapon (1) or the weapon barrel (6, 7) and a further control (12) for rotation of the weapon (1) or of the weapon barrel (6, 7) in the horizontal plane is provided. In accordance with a sixth embodiment of the present invention, the first embodiment, the second embodiment, the third embodiment, the fourth embodiment and the fifth embodiment are further modified so that, depending on the ammunition type (10), high-temperature elements or induction coils (30) on the weapon barrel (6, 7) are actuated at the same time. In accordance with a seventh embodiment of the present invention, the first embodiment, the second embodiment, the third embodiment, the fourth embodiment, the fifth embodiment, and the sixth embodiment are further modified so that two weapon barrels (6, 7) are incorporated. In accordance with an eighth embodiment of the invention, the fourth embodiment, the fifth embodiment, the sixth embodiment, and the seventh embodiment are further modified so that, after selection of a desired ammunition type, the magazine (8) is rotated into the appropriate position over the breech (5, 9) of the weapon barrel (6, 7) to be fired.

Thus, the present invention is based on the concept of providing a range control, or projectile energy control, by means of which it is possible to specify the firing velocity and, thus, the impact velocity of the ammunition or active bodies at the distance to be discharged, so that the ammunition can be fired at various individual distances, wherein, in particular, the non-lethal ammunition continues to act in a non-lethal manner. However, the result of this is that the muzzle energy can be adjusted in a continuously variable manner to the respective operation, or to the respective operation range, required. This projectile energy control can be realized by regulating the shot pressure. The shot pressure can be regulated, on the one hand, by regulating the operating gas pressure and/or, on the other hand, by influencing the valve characteristics (e.g., valve opening time). Because an incorrect pressure selection could have catastrophic consequences, it is additionally proposed that monitoring of the pressure level is not only limited to purely electronic monitoring of the pressure level.

A pneumatic weapon is proposed, in accordance with the present invention, that has a continuously variable range control using a shot pressure control or valve control, e.g., by means of a proportional pressure regulator, and/or additionally in conjunction with a breech technology. The shot distance is thereby specified via an energy control, due to which the ammunition accordingly flies a shorter or greater distance. Thus, the range control represents a scaling of the ammunition. The basis for this proposal was the knowledge that, in the control circuit for triggering the projectile pressure of a pneumatic weapon, two actuating variables are available, namely, the operating pressure in the air pressure vessel and the valve characteristics—determined by means of the opening behavior or the opening time.

The preferred regulating concept is, therefore, based on the setting of a maximum gas pressure as a base value for the shot assembly itself, wherein the fine control of the range then takes place via the valve control. Via a, preferably proportional, pressure regulator, the pressure in the gas vessel is therefore first set at a desired level, which prevents an excessive effect in the required operating range. The fine regulation then takes place via the selection of the optimum opening time of the valve used. The result is that the risk of accident can be excluded while maintaining the functional reliability, i.e., if the valve is open longer due to a faulty function, then based on the maximum primary pressure it is ensured that excessive energy can no longer be transmitted to the ammunition.

In addition, according to the present invention, the control of the pressure vessel can be ensured via a 2-fold redundant system. In other words, the control of the pressure vessel can be ensured using two proportional pressure regulators working independently of one another.

Another advantage of the present invention is that pyrotechnics, or propellants, are no longer needed for firing the ammunition. In addition, the discharge of various active agents from one system is now possible in a simple manner. Active agents can be additives, such as marking agents, fog bodies, irritant gas, flares, etc. Flare projectiles that operate without a disintegrator can also be fired. The ignition of these flares then takes place via high-temperature elements, or induction coils, mounted on the weapon barrel(s). The ammunition itself can omit an ammunition casing to accommodate the propellant so that casing disposal is not necessary. Higher cadences (e.g., up to 250 shots/min) can likewise be achieved by a weapon according to the present invention .

Thus, a range control for a weapon is proposed by means of which it is possible to determine, or set, the firing velocity and, thus, the impact velocity, of the ammunition or active bodies beforehand to the distance to be discharged. The weapon is a type of pneumatic weapon that experiences a stepless range control using a shot pressure control, e.g. by means of a proportional pressure regulator, and/or in combination with breech technology and valve technology. Ideally, the range of the compressed air weapon of the present invention can be controlled or set, in particular, from 0 m up to 500 m.

Based on an exemplary embodiment with drawings, the invention is to be explained below in more detail.

DETAILED DESCRIPTION OF THE INVENTION

Figure 1:
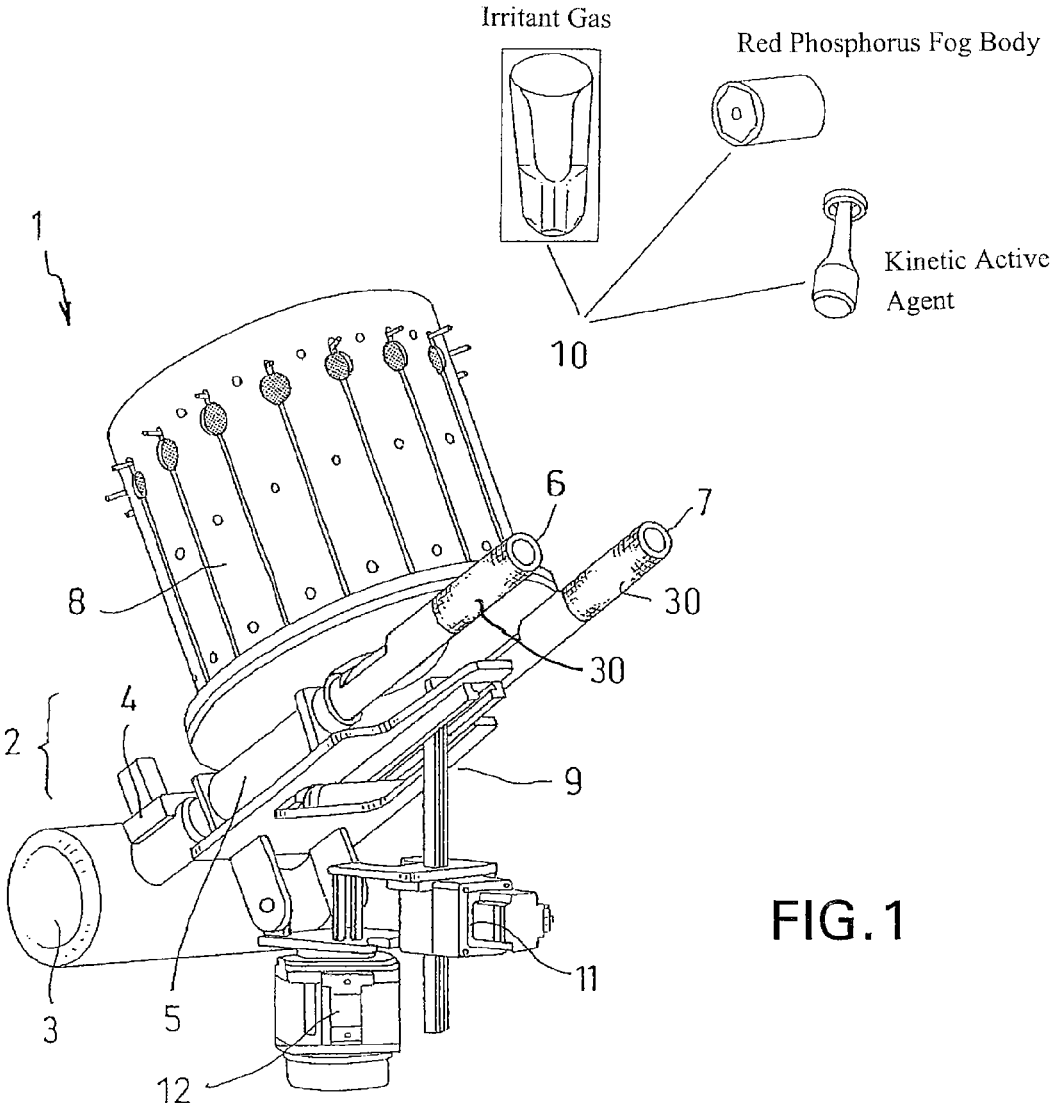
FIG. 1 that shows a compressed air weapon with two barrels and a barrel magazine 8 in accordance with the present invention.

In FIG. 1, a compressed air weapon 1, provided with a range control 2, is shown, wherein the range control 2 is composed of a controllable compressed air vessel 3 and a quick-acting valve 4 on the respective breech 5 and 9 of the weapon 1. The weapon 1, as shown, preferably has two weapon barrels 6, 7, so that a further quick-acting valve (not shown, but which is also referred to as the "second valve") is present on the breech 9 of the weapon barrel 7. Breech 5 is associated with weapon barrel 6. The weapon barrels 6, 7 can be supplemented by high-temperature elements or induction coils (not shown in more detail than elements 30 in FIG. 1), depending on the type of ignition of the ammunition or active bodies 10, or depending on programming.

Figure 4:
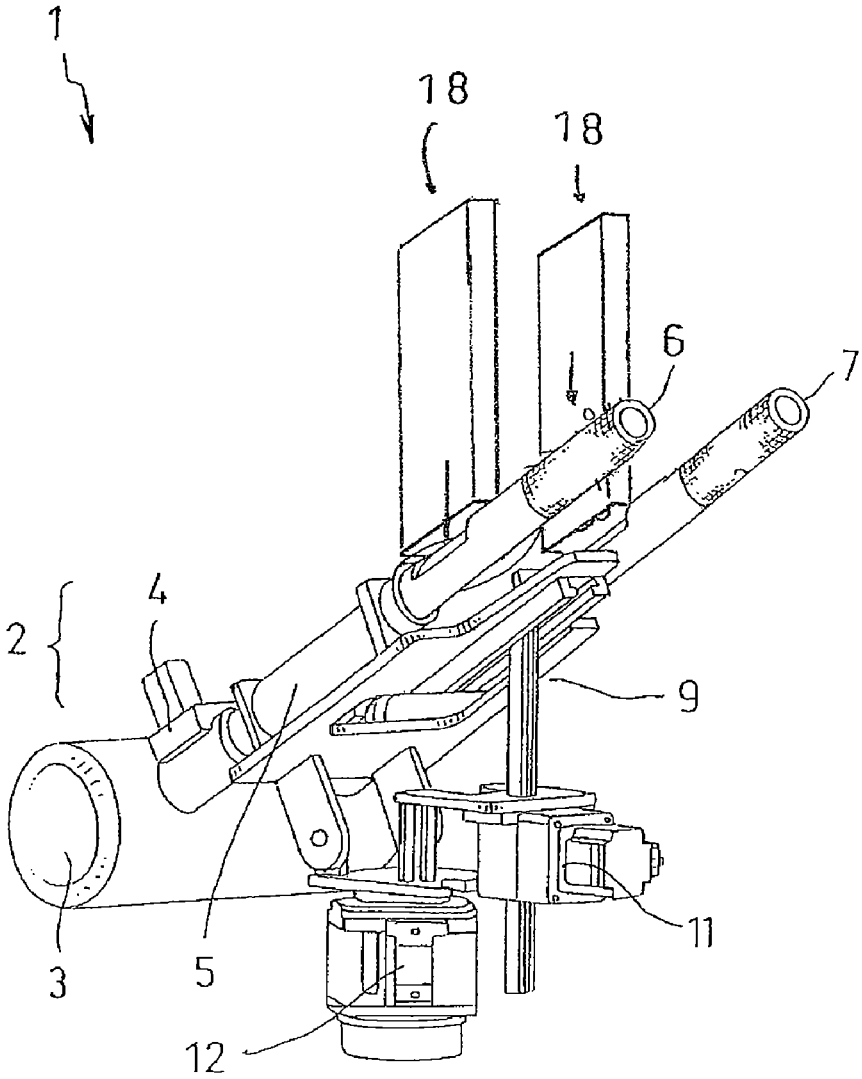
FIG. 4 shows a compressed air weapon with two barrels and a bar magazine 18 associated with each barrel.
Figure 5:
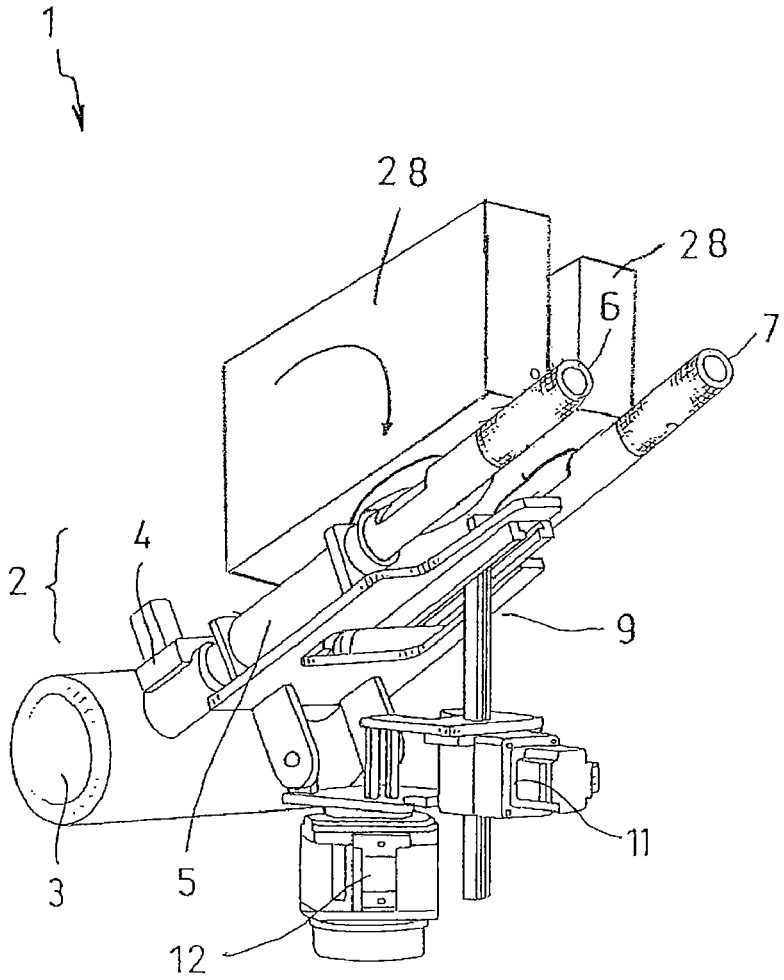
FIG. 5 shows a compressed air weapon with two barrels and a chain magazine 28 associated with each barrel.

A rotating drum magazine 8, for example, as shown in FIG. 1, for accommodating the ammunition 10 is mounted preferably above the weapon barrels 6, 7. However, as shown in FIGS. 4 and 5, respectively, the weapon may be provided with a bar magazine 18 or with a chain magazine 28. For aiming the weapon 1, a control 11 is incorporated for the vertical positioning of the weapon 1, or for the vertical positioning of the weapon barrels 6, 7. Another control 12 serves to rotate the weapon 1 in the horizontal plane. A mechanism that performs a method of transferring the ammunition 10 from the magazine 8 into the weapon barrels 6, 7 in front of the breeches 5, 9 is not shown in more detail, but is present.

MODE OF OPERATION OF THE WEAPON

Figure 3:
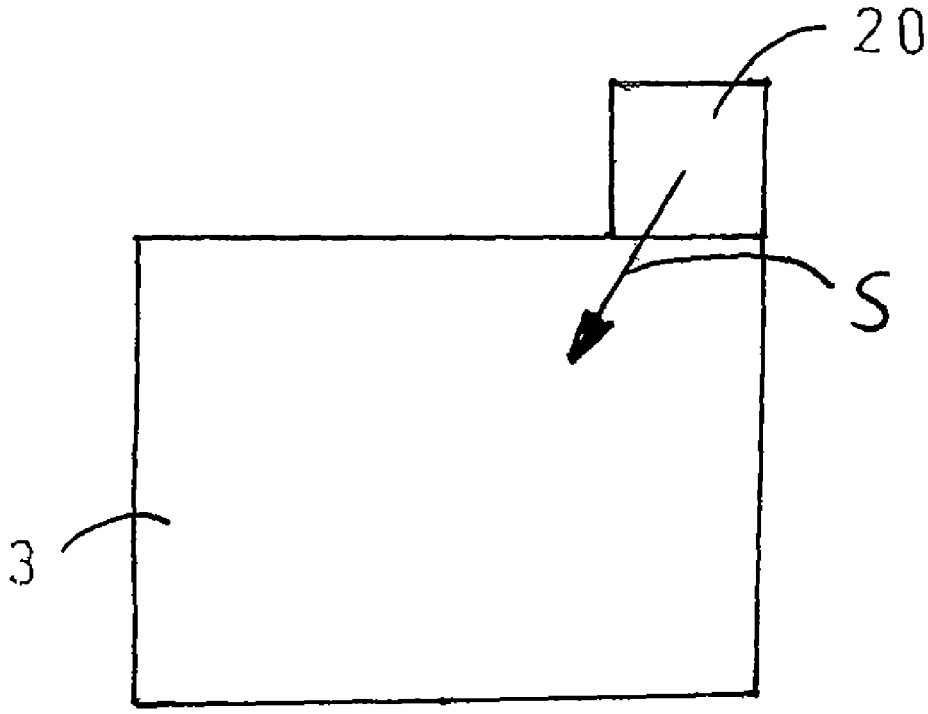
FIG. 3 is a schematic diagram that shows a control 20 on the compressed air vessel 3, wherein the controller 20 passes on a signal value S to the compressed air vessel.

The mode of operation of the weapon 1 is approximately as follows: After selection of a desired ammunition type 10 (e.g., irritant gas ammunition, red phosphorus fog body (smoke bomb) ammunition, and kinetic active agent ammunition), the magazine 8 rotates into the corresponding position above the breech 5 or 9. The user selects the desired range, which is passed on as a signal value S via a control 20 on the compressed air vessel 3 (for example, the control 20 may be a proportional pressure controller) as shown in FIG. 3. This sets the corresponding pressure in the pressure vessel 3. The pressure is set, as a base value, to a maximum gas pressure provided for this range. To this end, an optimum opening time of the respectively used valve (i.e., valve 4 when weapon barrel 6 is used and a second valve when weapon barrel 7 is used) is deposited for each operating pressure, or shot pressure, with respect to performance and consumption. Parallel to this, if necessary, the weapon 1 is aimed via the controls 11, 12. Depending on the ammunition type 10, the high-temperature elements, or induction coils 30, are actuated at the same time. When the weapon system is ready to fire, the ammunition 10 is shot from the corresponding weapon barrel 5, 9 by means of compressed air.

If, for example, a range of 50 m is to be achieved for a non-lethal ammunition effect, then the pressure is adjusted to 10 bar, for example. The optimum valve opening time is deposited in the fire control and, thus, becomes fixed (See, e.g., FIG. 2). The range control 2 calls on this fixed optimum valve opening time. Therefore functions, or optimum valve opening times, that preset or offer the optimum opening times depending on the determined shot pressure for the desired purpose (i.e., desired range and desired effect) are backed up in the fire control.

Figure 2:
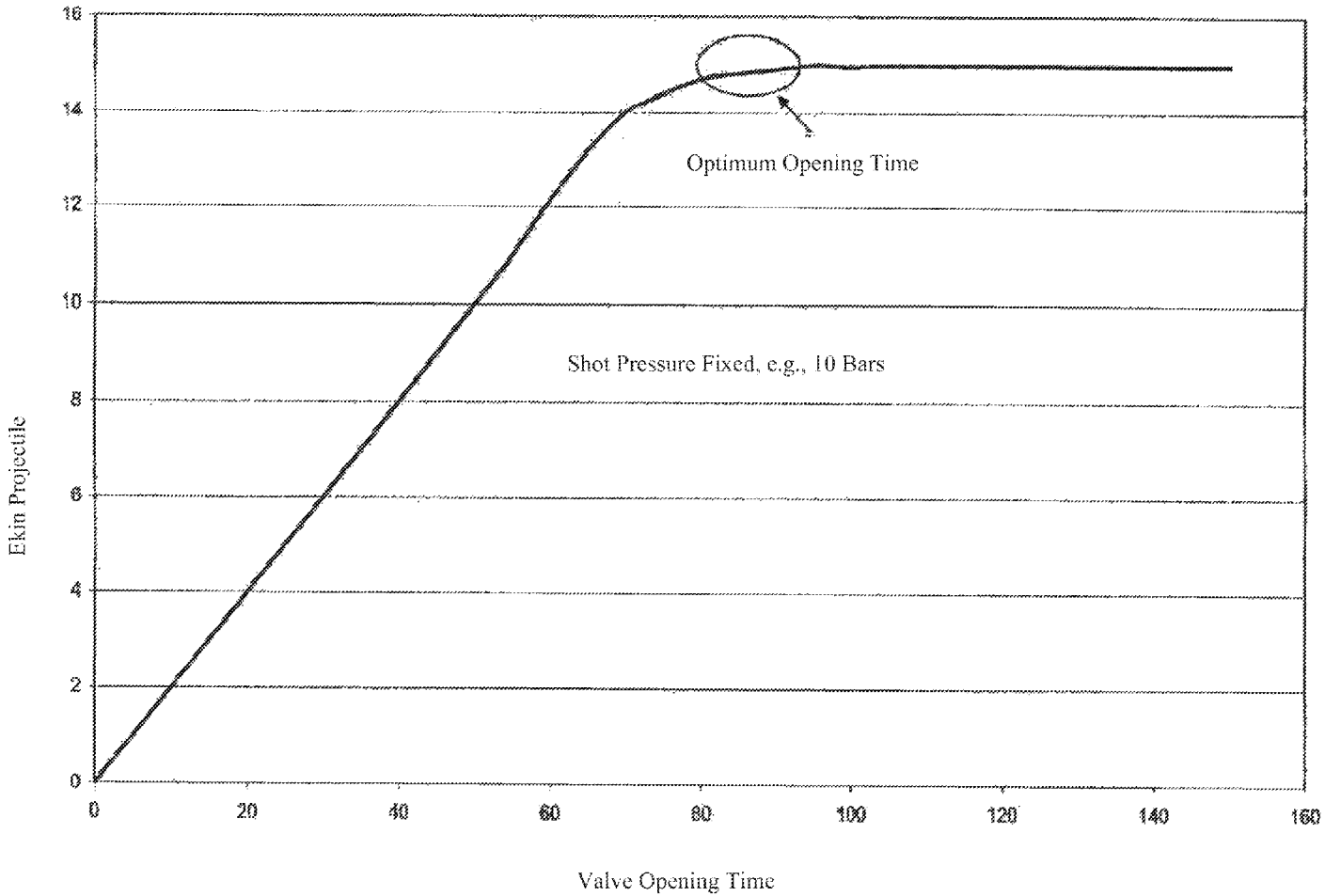
FIG. 2 that shows a function curve for a valve control, in accordance with the present invention.

In FIG. 2, the horizontal axis represents valve opening time, and the vertical axis pertains to the kinetic energy ($E_{kin}$) of the projectile, wherein for the shot pressure fixed at, e.g. 10 bar, the optimum opening time is shown.

The shot cadence, as well as the number of the ammunition bodies or active bodies 10 to be fired, can be set as needed via a control panel (not shown in more detail) before actuation.

The invention claimed is:

1. A range-controlled compressed air weapon comprising:

(a) one or more weapon barrels, wherein each weapon barrel is associated with a breech;

(b) a range control device comprising i. a compressed air vessel; and ii. a valve disposed on each breech of the weapon barrel; and (c) an incorporated accommodation for ammunition disposed above the one or more weapon barrels, wherein the range control device is operable to regulate shot pressure in order to provide range control, wherein the range control device regulates shot pressure by regulating operating gas pressure of the compressed air vessel, or by influencing a valve characteristic of each valve, or by regulating both the operating gas pressure of the compressed air vessel and the valve characteristic of each valve, wherein the valve characteristic is valve opening time, and wherein the range control device provides a base value range control by setting the operating gas pressure of the compressed air vessel to a selected maximum gas pressure and the range control device provides fine control of the base value range control by setting the valve opening time for the valve to a selected optimum valve opening time.

2. A weapon according to claim 1, wherein a desired range for the weapon is transmitted to the compressed air vessel or to the valve as a signal value via a controller.

3. A weapon according to claim 2, wherein a maximum gas pressure is set in the compressed air vessel by the controller, and the valve is opened for each operating pressure, or for each shot pressure, within an optimum valve opening time.

4. A weapon according to claim 3, wherein the accommodation for ammunition is selected from the group consisting of a rotating drum magazine, a bar magazine and a chain magazine.

5. A weapon according to claim 2, wherein the accommodation for ammunition is selected from the group consisting of a rotating drum magazine, a bar magazine and a chain magazine.

6. A weapon according to claim 1, wherein a maximum gas pressure is set in the compressed air vessel by a controller, and the valve is opened for each operating pressure, or for each shot pressure, within an optimum valve opening time.

7. A weapon according to claim 6, wherein the accommodation for ammunition is selected from the group consisting of a rotating drum magazine, a bar magazine and a chain magazine.

8. A weapon according to claim 1, wherein the accommodation for ammunition is selected from the group consisting of a rotating drum magazine, a bar magazine and a chain magazine.

9. A weapon according to claim 8, wherein after selection of a desired ammunition type, the magazine is rotatable into an appropriate position over the breech of the corresponding weapon barrel that is to be fired.

10. A weapon according to claim 1, wherein the weapon further comprises, in order to aim the weapon:

(d) a first control disposed to provide vertical positioning of the weapon or to provide vertical positioning of each weapon barrel; and (e) a second control disposed to provide rotation of the weapon or to provide rotation of each weapon barrel in the horizontal plane.

11. A weapon according to claim 1, wherein the weapon incorporates two weapon barrels.

12. A weapon according to claim 1, wherein the range of the weapon is controllable by the range control device from 0 m up to 500 m.

13. A range-controlled compressed air weapon having:

(a) at least one weapon barrel; and (b) a range control device comprising a compressed air vessel and a valve on each breech of the at least one weapon barrel, wherein the range control is realized by regulating a shot pressure, wherein regulation of the shot pressure takes place by regulating the operating gas pressure, or by influencing characteristics of the valve, or by regulating the operating pressure and by influencing characteristics of the valve, wherein the characteristics of the valve that are influenced to regulate shot pressure include a valve opening time, and wherein the range control device provides a base value range control by setting the operating gas pressure of the compressed air vessel to a selected maximum gas pressure and the range control device provides fine control of the base value range control by setting the valve opening time for the valve to a selected optimum valve opening time.

14. A weapon according to claim 13, wherein the range of the weapon is controllable by the range control device from 0 m up to 500 m.

15. A range-controlled compressed air weapon comprising:

(a) one or more weapon barrels, wherein each weapon barrel is associated with a breech;

(b) a range control device comprising i. a compressed air vessel; and ii. a valve disposed on each breech of the weapon barrel;

(c) an incorporated accommodation for ammunition disposed above the one or more weapon barrels; and (d) a plurality of high temperature elements and a plurality of induction coils disposed on each weapon barrel, and depending on ammunition type used by the weapon, the high-temperature elements, or the induction coils, disposed on each weapon barrel are actuated at the same time, wherein the range control device is operable to regulate shot pressure in order to provide range control, wherein the range control device regulates shot pressure by regulating operating gas pressure of the compressed air vessel, or by influencing a valve characteristic of each valve, or by regulating both the operating gas pressure of the compressed air vessel and the valve characteristic of each valve, wherein the valve characteristic is valve opening time, and wherein the range control device provides a base value range control by setting the operating gas pressure of the compressed air vessel to a selected maximum gas pressure and the range control device provides fine control of the base value range control by setting the valve opening time for the valve to a selected optimum valve opening time.

16. A weapon according to claim 15, wherein the range of the weapon is controllable by the range control device from 0 m up to 500 m.

* * * * *